US011637411B2

(12) United States Patent
Sim et al.

(10) Patent No.: US 11,637,411 B2
(45) Date of Patent: Apr. 25, 2023

(54) SPARK PLUG

(71) Applicants: HYUNDAI MOTOR COMPANY, Seoul (KR); KIA CORPORATION, Seoul (KR)

(72) Inventors: Kiseon Sim, Suwon-si (KR); Soo Hyung Woo, Seoul (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 17/842,224

(22) Filed: Jun. 16, 2022

(65) Prior Publication Data

US 2023/0055431 A1 Feb. 23, 2023

(30) Foreign Application Priority Data

Aug. 19, 2021 (KR) ..... 10-2021-0109318

(51) Int. Cl.
*H01T 13/46* (2006.01)

(52) U.S. Cl.
CPC ..... *H01T 13/462* (2013.01)

(58) Field of Classification Search
CPC ..... H01T 13/46; H01T 13/462; H01T 13/465; H01T 13/467
USPC ..... 313/123
See application file for complete search history.

(56) References Cited

U.S. PATENT DOCUMENTS

| | | | | | |
|---|---|---|---|---|---|
| 3,353,052 | A * | 11/1967 | Barry | H01T 13/22 | 315/36 |
| 4,004,562 | A * | 1/1977 | Rado | H01T 13/462 | 313/142 |
| 4,308,487 | A * | 12/1981 | Feaster | H01T 13/22 | 315/71 |
| 5,918,571 | A * | 7/1999 | Below | H01T 13/467 | 313/144 |
| 7,741,762 | B2 * | 6/2010 | Alger, II | H01T 13/54 | 313/119 |
| 11,251,588 | B1 * | 2/2022 | Woo | H01T 13/467 | |
| 2004/0195949 | A1 * | 10/2004 | Hiramatsu | H01T 13/467 | 313/135 |
| 2014/0076295 | A1 * | 3/2014 | Zheng | F02P 7/10 | 123/621 |
| 2017/0229844 | A1 * | 8/2017 | Minami | H01T 13/24 | |
| 2017/0254312 | A1 * | 9/2017 | Zheng | F02P 3/0442 | |
| 2018/0142664 | A1 * | 5/2018 | Assaad | H01T 13/22 | |
| 2020/0235552 | A1 * | 7/2020 | Fuchs | H01T 13/50 | |
| 2020/0256308 | A1 * | 8/2020 | Assaad | H01T 13/41 | |
| 2021/0399531 | A1 * | 12/2021 | Woo | H01T 13/467 | |
| 2022/0140576 | A1 * | 5/2022 | Niessner | H01T 13/54 | 315/246 |

* cited by examiner

*Primary Examiner* — Christopher M Raabe
(74) *Attorney, Agent, or Firm* — McDonnell Boehnen Hulbert & Berghoff LLP

(57) ABSTRACT

A spark plug includes a metal body member formed of a metal material, an insulating body member provided inside the metal body member and formed of an insulating material, a pair of central electrodes provided inside the insulating body member and having different polarities, and a ground electrode extending from the metal body member between a pair of central electrodes.

9 Claims, 9 Drawing Sheets

SPARK PLUG

CROSS REFERENCE TO RELATED APPLICATIONS

This application claims priority to and the benefit of Korean Patent Application No. 10-2021-0109318 filed in the Korean Intellectual Property Office on Aug. 19, 2021, the entire contents of which are incorporated herein by reference.

BACKGROUND

(a) Field

The present disclosure relates to a spark plug. More particularly, the present disclosure relates to a spark plug including two central electrodes and one ground electrode.

(b) Description of the Related Art

In gasoline vehicles, a gas mixture of air and a fuel is ignited by a spark generated from a spark plug to cause combustion. That is, the gas mixture injected into the combustion chamber during a compression stroke is ignited by the discharge phenomenon of the spark plug, and energy necessary for vehicle driving is generated while going through a high temperature and high pressure expansion process.

The spark plug provided in the gasoline vehicle serves to ignite the compressed gas mixture by the spark discharge due to a high voltage current generated in an ignition coil.

That is, in the conventional spark plug, the gas mixture inflowed into the combustion chamber is ignited by the spark discharge generated between a central electrode to which the current is supplied from the ignition coil and a ground electrode grounded to a cylinder head of the engine.

In a case of a general gasoline engine, it is mainly operated to be combusted with a stoichiometric air/fuel ratio (14.7:1, $\lambda=1$).

However, for the engine to achieve lean burn combustion, the air/fuel ratio is approximately 30:1$\lambda=2$. In this case, since the amount of injected fuel is very small compared to the amount of air in the gas mixture in the combustion chamber, even if the spark discharge occurs by the spark plug, the gas mixture is not ignited (misfire) or incomplete combustion occurs.

The above information disclosed in this Background section is only for enhancement of understanding of the background of the disclosure, and therefore it may contain information that does not form the prior art that is already known in this country to a person of ordinary skill in the art.

SUMMARY

The present disclosure to solve the problem as described above is to provide a spark plug that may increase ignition efficiency of the engine.

A spark plug according to an embodiment of the present disclosure includes a metal body member formed of a metal material, an insulating body member provided inside the metal body member and formed of an insulating material, a pair of central electrodes provided inside the insulating body member and having different polarities, and a ground electrode extending from the metal body member between the pair of central electrodes.

The pair of central electrodes are disposed at a predetermined distance from each other at the center of the lower part of the insulating body member.

The pair of central electrodes may include a positive electrode and a negative electrode.

The ground electrode may include a ground vertical portion extending downward from the lower end portion of the metal body member, and a ground horizontal portion extending between the pair of central electrodes from the ground vertical portion.

A spark plug according to another embodiment of the present disclosure may include a metal body member formed of a metal material, an insulating body member provided inside the metal body member and formed of an insulating material, a pair of central electrodes provided inside the insulating body member and having different polarities, and a ground electrode formed across the pair of central electrodes at both ends of the metal body member.

The pair of central electrodes may be disposed at a predetermined distance from each other on the center of the lower part of the insulating body member.

The pair of central electrodes may include a positive electrode and a negative electrode.

The ground electrode may include a first ground vertical portion extending downward from one lower end of the metal body member, a second ground vertical portion extending downward from the other lower end of the metal body member, and a ground horizontal portion connecting the first ground vertical portion and the second ground vertical portion.

A spark plug according to another embodiment of the present disclosure may include a metal body member formed of a metal material, an insulating body member provided inside the metal body member and formed of an insulating material, a pair of central electrodes provided inside the insulating body member and having different polarities, and a ground electrode formed across the pair of central electrodes from the metal body member.

The pair of central electrodes may be disposed at a predetermined distance from each other on the lower center of the insulating body member.

The pair of central electrodes may include a positive electrode and a negative electrode.

The ground electrode may include a ground vertical portion extending downward from the lower end portion of the metal body member, and a ground horizontal portion extending from the ground vertical portion by a predetermined length.

According to the spark plug according to an embodiment of the present disclosure as described above, by generating the spark discharge between two central electrodes and one ground electrode, the ignition efficiency of the gas mixture is improved.

Further, since the size of an initial combustion flame nucleus increases, the combustion speed may be improved.

Also, by improving the combustion speed, the efficiency of the engine may be improved, the engine output may be increased, and the emission may be improved.

BRIEF DESCRIPTION OF THE FIGURES

The drawings are provided for reference to explain an illustrative embodiment of the present disclosure, and the technical spirit of the present disclosure should not be interpreted to be limited to the accompanying drawings.

DETAILED DESCRIPTION

Figure 1:
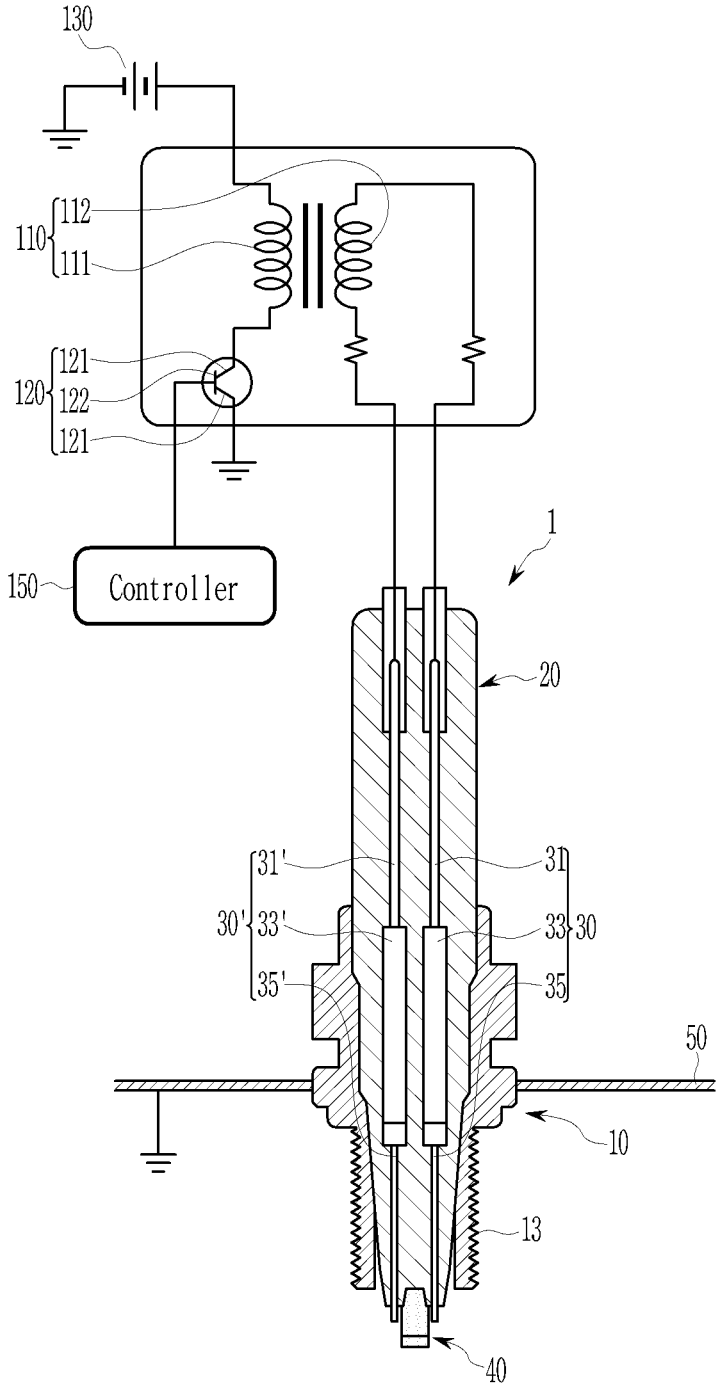
FIG. 1 is a cross-sectional view of a spark plug according to an embodiment of the present disclosure.

The present disclosure will be described more fully hereinafter with reference to the accompanying drawings, in which embodiments of the disclosure are shown. As those skilled in the art would realize, the described embodiments may be modified in various different ways, all without departing from the spirit or scope of the present disclosure.

Drawings and descriptions are to be regarded as illustrative in nature and not restrictive, and like reference numerals designate like elements throughout the specification.

Further, since sizes and thicknesses of constituent members shown in the accompanying drawings are arbitrarily given for better understanding and ease of description, the present disclosure is not limited to the illustrated sizes and thicknesses.

Hereinafter, a dual spark plug according to an embodiment of the present disclosure is described in detail with reference to the accompanying drawings.

Figure 2:
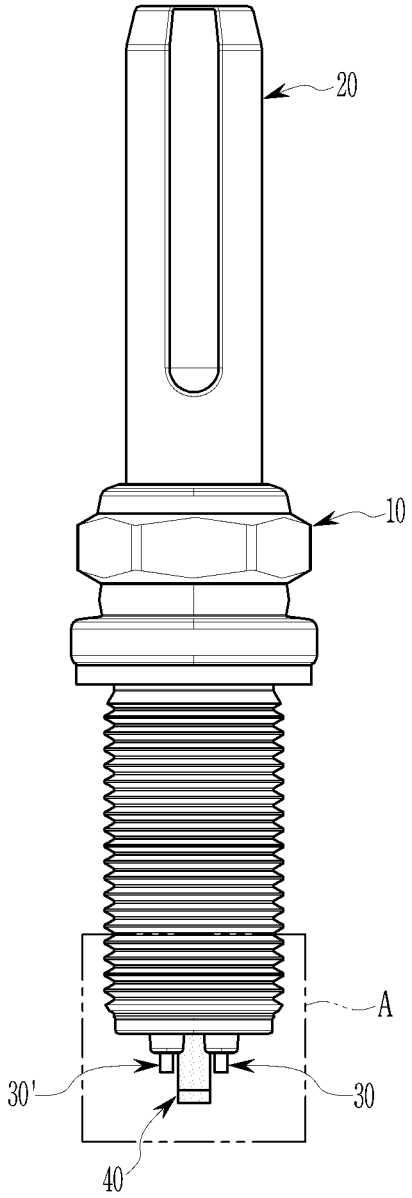
FIG. 2 is a lateral view of a spark plug according to an embodiment of the present disclosure.
Figure 3:
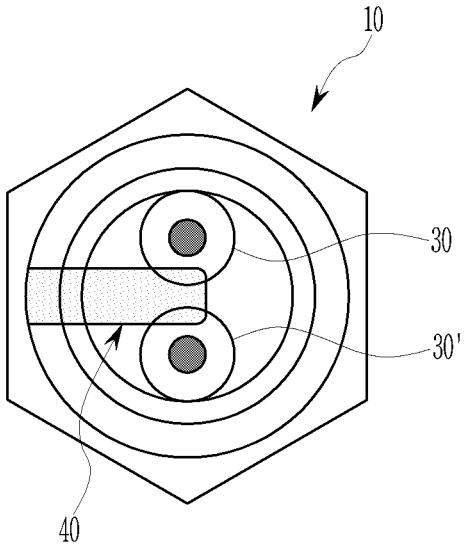
FIG. 3 is a bottom view of a spark plug according to an embodiment of the present disclosure.
Figure 4:
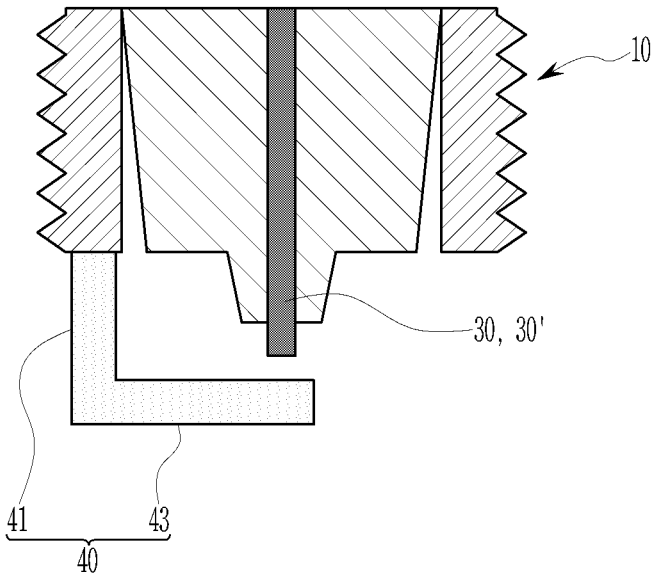
FIG. 4 is an enlarged view of a display unit 'A' of FIG. 2.

FIG. 1 is a cross-sectional view of a spark plug according to an embodiment of the present disclosure. FIG. 2 is a lateral view of a spark plug according to an embodiment of the present disclosure. FIG. 3 is a bottom view of a spark plug according to an embodiment of the present disclosure. FIG. 4 is an enlarged view of a display unit 'A' of FIG. 2.

As shown in FIG. 1 to FIG. 4, a spark plug according to an embodiment of the present disclosure may include a metal body member 10 formed of a metal material, an insulating body member 20 provided inside the metal body member 10 and formed of an insulating material, a pair of central electrodes 30 and 30' provided inside the insulating body member 20 and having different polarities, and a ground electrode 40 extending from the metal body member 10 and generating a spark discharge with the central electrodes 30 and 30'.

The pair of central electrodes 30 and 30' include a positive electrode 30 and a negative electrode 30'. The positive and negative electrodes receive a high voltage current from an ignition coil 110.

The metal body member 10 is a part mounted on a cylinder head 50 of the engine and is formed in an approximately cylindrical shape, and the lower outer side of the metal body member 10 includes a threaded portion 13 in which a thread is formed for coupling with the cylinder head 50. Another thread corresponding to the thread of the metal body member 10 is formed in the cylinder head 50 of the engine. That is, the dual spark plug and the cylinder head 50 of the engine are screwed together. The metal body member 10 and the cylinder head 50 of the engine are screwed together, and the metal body member 10 and the ground electrode 40 form a ground terminal.

In an embodiment of the present disclosure, the ground electrode 40 forming the ground terminal does not necessarily mean 0 V, but refers to an electrode that maintains a reference potential.

Therefore, the potential of the positive electrode 30 of the central electrode is higher than the potential of the ground electrode 40, and the potential of the negative electrode 30' of the central electrode is lower than the potential of the ground electrode. Therefore, one spark discharge is generated by the potential difference between the positive electrode 30 and the ground electrode 40, and another spark discharge is generated by the potential difference between the negative electrode 30' and the ground electrode 40.

The insulating body member 20 may be formed of a ceramic material, and is provided inside the metal body member 10. The insulating body member 20 may prevent a pair of metal materials from being electrically short-circuited with each other.

The pair of central electrodes 30 and 30' are provided inside the insulating body member 20, and may be disposed apart from each other by a certain distance. For example, a pair of central electrodes may be disposed apart from the center of the lower part of the insulating body member by a predetermined distance.

The pair of central electrodes 30 and 30' include a first central electrode 30 and a second central electrode 30', and each central electrode 30 and 30' may include a terminal part 31 and 31', a noise filter part 33 and 33', and an electrode part 35 and 35'.

The terminal parts 31 and 31' of the central electrodes 30 and 30' are electrically connected to the ignition coil 110. At this time, the terminal parts 31 and 31' of the central electrodes 30 and 30' may be extended to the upper center of the insulating body member 20 and electrically connected to the ignition coil 110.

The noise filter parts 33 and 33' of the central electrodes 30 and 30' are to remove a noise that may be generated when a current (or a voltage) is applied from the ignition coil 110 to the electrode parts 35 and 35' of the central electrodes 30 and 30', and may be formed to surround the central portion of the metal electrode. The noise filter parts 33 and 33' may be formed of a glass material.

The electrode parts 35 and 35' of the central electrodes 30 and 30' are parts where the spark discharge occurs with the ground electrode 40. The central electrodes 30 and 30' may extend below the insulating body member 20.

The pair of central electrodes 30 and 30' are spaced apart from each other at the center of the lower part of the insulating body member 20 by a predetermined distance.

The ground electrode 40 may include a ground vertical portion 41 extending downward from the lower end portion of the metal body member 10, and a ground horizontal portion 43 extending from the ground vertical portion 41 between a pair of central electrodes 30 and 30'. That is, the ground horizontal portion 43 extends inward in the radial direction of the metal body member 10 from the end of the ground vertical portion 41, so that the end of the ground horizontal portion 43 is positioned at the central portion between a pair of central electrodes 30 and 30'.

At this time, the distance between the positive electrode 30 and the end of the ground electrode 40 and the distance between the negative electrode 30' and the end of the ground electrode 40 are formed to be shorter than the distance between the positive electrode 30 and the negative electrode 30'.

Meanwhile, the ignition coil 110 supplies the current to a pair of central electrodes 30 and 30'.

Referring to FIG. 1, the ignition coil 110 includes a primary coil 111 and a secondary coil 112. One end of the primary side coil 111 is electrically connected to the battery 130, and the other end of the primary side coil 111 is grounded through the switch 120. Depending on the on/off of the switch 120, the primary side coil 111 of the ignition coil 110 may be selectively conductive.

The switch 120 may be implemented through a transistor switch 120 (e.g., an IGBT: insulated gate bipolar transistor) including an emitter terminal 121, a collector terminal 123, and a base terminal 122. That is, the other end of the primary side coil 111 may be electrically connected to the collector terminal 123 of the switch 120, the emitter terminal 121 may be grounded, and the base terminal 122 may be electrically connected to the controller 150.

One end of the secondary coil 112 is electrically connected to one central electrode 30 of a pair of central electrodes 30 and 30', and the other end of the secondary coil 112 is electrically connected to the other central electrode of a pair of central electrodes 30 and 30'.

When the controller 150 applies a control signal to the base terminal 122 of the switch 120, the primary side coil 111 of the ignition coil 110 is energized and electrical energy is charged to the primary side coil 111.

If the controller 150 does not apply a control signal to the base terminal 122 of the switch 120, a high voltage current (or a discharge current) is generated in the secondary coil 112 due to electromagnetic induction of the primary coil 111 and the secondary coil 112.

That is, the controller 150 turns the switch 120 on/off to charge or discharge the ignition coil 110. When the controller 150 applies the control signal to the base terminal 122 of the switch 120 (or when the switch 120 is turned on), the primary coil 111 is charged.

Further, if the controller 150 does not apply the control signal to the base terminal 122 of the switch 120 (or when the switch 120 is turned off), a high voltage current is generated in the secondary coil 112 due to the electromagnetic induction with the primary coil 111, and the spark discharge occurs between the pair of central electrodes 30 and 30' and the ground electrode 40 by the high voltage current generated from the secondary coil 112.

Here, the central electrode electrically connected to one end of the secondary coil 112 having the relatively high voltage is the positive electrode 30, and the central electrode electrically connected to the other end having the relatively low voltage is the negative electrode 30'.

Next, the spark plug according to another embodiment of the present disclosure is described in detail with reference to the accompanying drawings.

Figure 5:
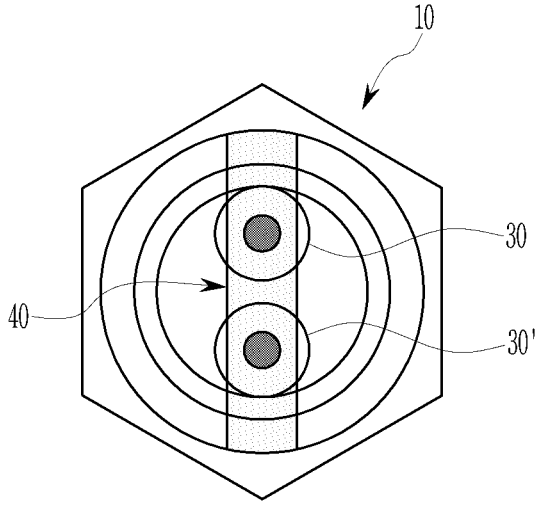
FIG. 5 is a bottom view of a spark plug according to another embodiment of the present disclosure.
Figure 6:
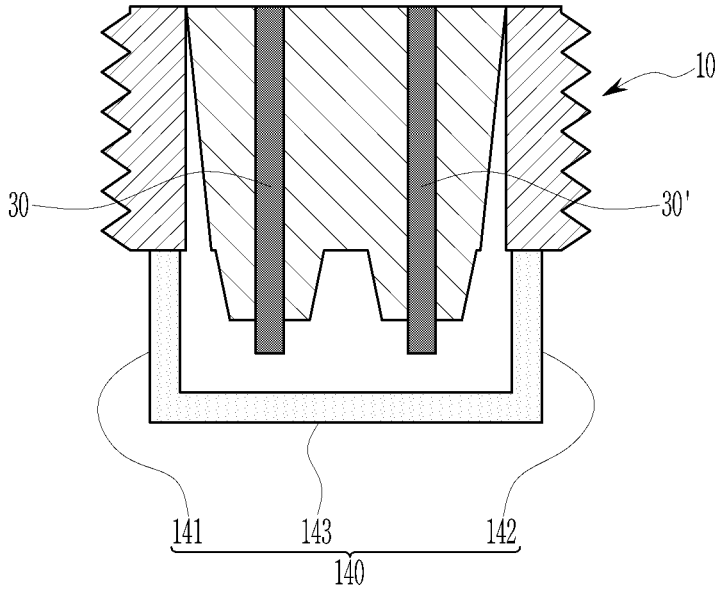
FIG. 6 is a partial lateral view of a spark plug according to another embodiment of the present disclosure.

FIG. 5 is a bottom view of a spark plug according to another embodiment of the present disclosure. FIG. 6 is a partial lateral view of a spark plug according to another embodiment of the present disclosure.

The spark plug according to the other embodiment of the present disclosure is substantially the same as or similar to the basic configuration of the spark plug according to the embodiment of the present disclosure described above. However, since only the configuration of the ground electrode is partially different, only parts that are different from the embodiment described above are described below.

As shown in FIG. 5 and FIG. 6, the ground electrode 140 of the spark plug according to another embodiment of the present disclosure may be formed across a pair of central electrodes 30 and 30' at both ends of the metal body member 10.

That is, the ground electrode 140 includes a first ground vertical portion 141 extending downward from one lower end of the metal body member 10, a second ground vertical portion 142 extending downward from the other lower end of the metal body member 10, and a ground horizontal portion 143 connecting the first ground vertical portion 141 and the second ground vertical portion 142.

At this time, the ground horizontal portion 143 is crosses the pair of central electrodes 30 and 30'. In other words, the ground horizontal portion 143 is positioned on a vertical lower portion of a pair of central electrodes 30 and 30'.

Here, a distance between the positive electrode 30 and the ground horizontal portion 143 and a distance between the negative electrode 30' and the ground horizontal portion 143 is shorter than a distance between the positive electrode 30 and the negative electrode 30'.

Finally, the spark plug according to another embodiment of the present disclosure is described in detail with reference to the accompanying drawing.

Figure 7:
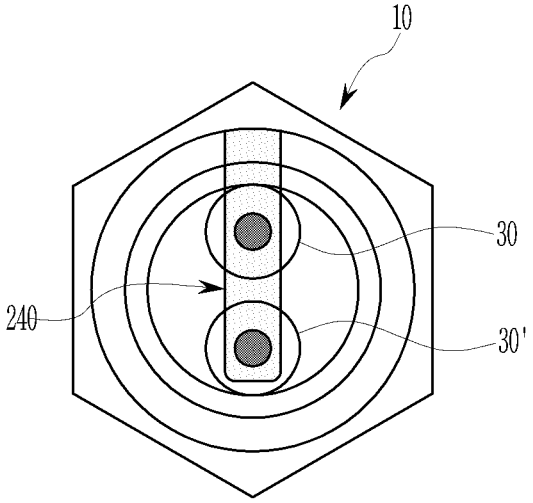
FIG. 7 is a bottom view of a spark plug according to another embodiment of the present disclosure.
Figure 8:
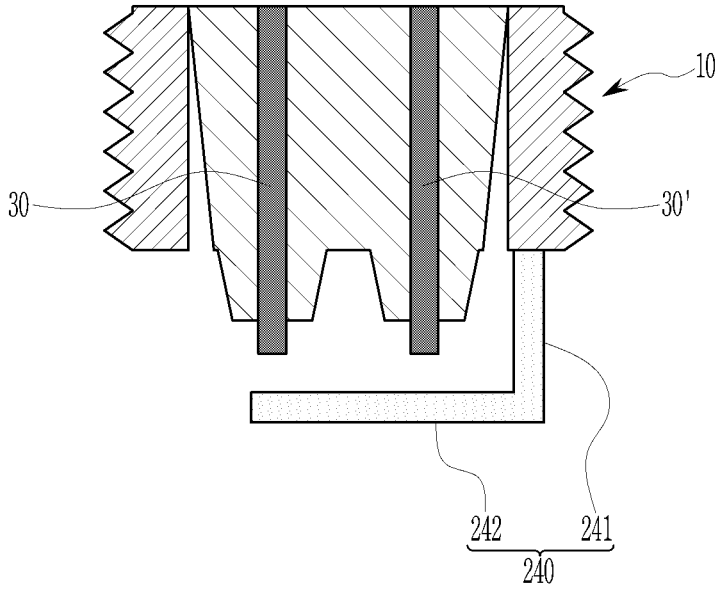
FIG. 8 is a partial lateral view of a spark plug according to another embodiment of the present disclosure.

FIG. 7 is a bottom view of a spark plug according to another embodiment of the present disclosure. FIG. 8 is a partial lateral view of a spark plug according to another embodiment of the present disclosure.

The spark plug according to another embodiment of the present disclosure is substantially the same or similar in the basic configuration of the spark plug according to an embodiment of the present disclosure described above. However, since only the configuration of the ground electrode is partially different, only parts that are different from the embodiment described above are described below.

As shown in FIG. 7 and FIG. 8, the ground electrode 240 of the spark plug according to another embodiment of the present disclosure may include a ground electrode formed across a pair of central electrodes 30 and 30' in the metal body member 10.

That is, the ground electrode 240 may include a ground vertical portion 241 extending downward from the lower end portion of the metal body member 10 and a ground horizontal portion 243 extending from the ground vertical portion 241 by a predetermined length.

At this time, the ground horizontal portion 243 crosses the pair of central electrodes 30 and 30'. In other words, the ground horizontal portion 243 is positioned on the vertical lower portion of a pair of central electrodes 30 and 30'.

Here, the distance between the positive electrode 30 and the ground horizontal portion 243 and the distance between the negative electrode 30' and the ground horizontal portion 243 are formed to be shorter than the distance between the positive electrode 30 and the negative electrode 30'.

Hereinafter, the operation of the spark plug according to an embodiment of the present disclosure as described above is described in detail with reference to the accompanying drawings.

FIGS. 9A-9D are views to explain an operation of a spark plug according to an embodiment of the present disclosure.

Figures 9A, 9B, 9C, 9D:
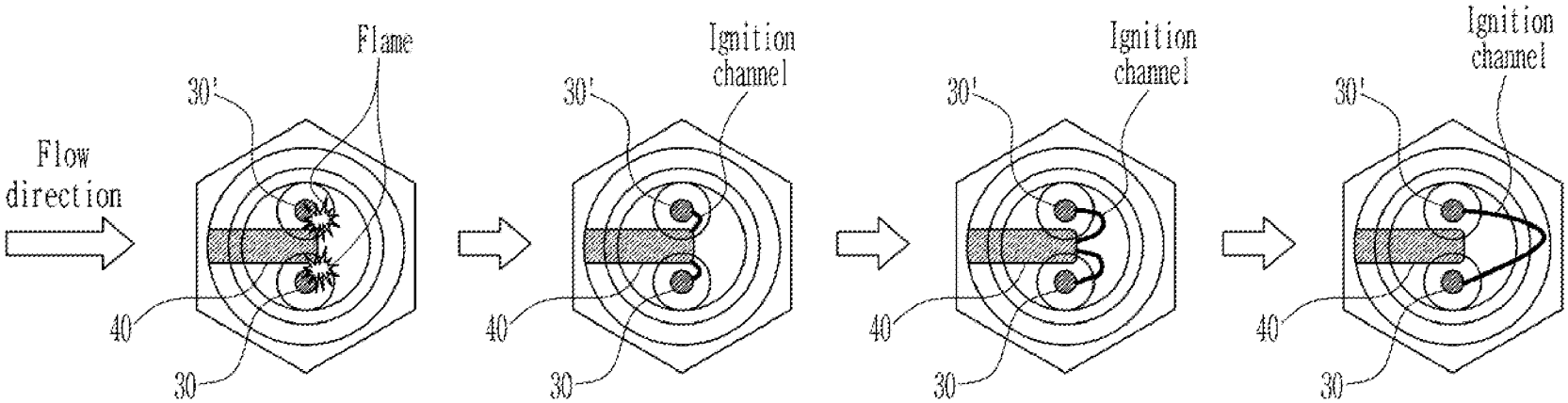
FIGS. 9A, 9B, 9C, and 9D are views to explain an operation of a spark plug according to an embodiment of the present disclosure.

Referring to FIGS. 9A-9D, when the current is applied from the secondary coil 112 of the ignition coil 110 to the positive electrode 30 and the negative electrode 30' of the central electrodes 30 and 30', the spark discharge occurs between the positive electrode 30 and the ground electrode 40 and between the negative electrode 30' and the ground electrode 40 (referring to FIG. 9A).

At this time, since the potential of the ground electrode 40 is higher than that of the positive electrode 30, the current flows from the positive electrode 30 to the ground electrode 40 and one spark discharge is generated. Also, since the potential of the ground electrode 40 is higher than that of the negative electrode 30', the current flows from the ground electrode 40 to the negative electrode 30' and another spark discharge occurs.

By the spark discharge generated between the positive electrode 30 and the ground electrode 40 and between the negative electrode 30' and the ground electrode 40, respectively, an ignition channel where the current of the high voltage flows is formed between the positive electrode 30 and the ground electrode 40 and between the negative electrode 30' and the ground electrode 40. At the beginning of the ignition, the ignition channel formed between the positive electrode 30 and the ground electrode 40 and between the negative electrode 30' and the ground electrode 40 gradually increases along the flow direction inside the combustion chamber (referring to FIG. 9B and FIG. 9C). Here, the ignition channel means an electrical channel through which the current flows between the positive electrode 30 and the ground electrode 40 and between the ground electrode 40 and the negative electrode 30'.

Two ignition channels gradually increasing along the flow direction inside the combustion chamber form one ignition channel by electrical attraction over time (referring to FIG. 9D). At this time, the current flows from the positive electrode to the negative electrode.

At the beginning of ignition, two ignition channels are formed, and over time, two ignition channels form one ignition channel expanded by the electrical attraction.

In this way, as the relatively large flame nucleus is formed by one extended ignition channel formed when two ignition channels are merged by the electrical attraction, the ignition efficiency may be improved, and the initial combustion speed may be improved. Further, as the combustion speed may be improved, the efficiency of the engine and the output of the engine may be improved, and the emission may be improved.

While this disclosure has been described in connection with what is presently considered to be practical embodiments, it is to be understood that the disclosure is not limited to the disclosed embodiments. On the contrary, it is intended to cover various modifications and equivalent arrangements included within the spirit and scope of the appended claims.

The invention claimed is:

1. A spark plug comprising:

a metal body member formed of a metal material;

an insulating body member positioned inside the metal body member and formed of an insulating material;

a pair of central electrodes positioned inside the insulating body member and having different polarities; and a ground electrode extending from the metal body member between the pair of central electrodes;

wherein the ground electrode includes:

a ground vertical portion extending downward from a lower end portion of the metal body member; and a ground horizontal portion extending between the pair of central electrodes from the ground vertical portion; and wherein a distance between the positive electrode and the end of the ground electrode and a distance between the negative electrode and the end of the ground electrode is shorter than a distance between the positive electrode and the negative electrode.

2. The spark plug of claim 1, wherein the pair of central electrodes are positioned at a predetermined distance from each other at a center of a lower part of the insulating body member.

3. The spark plug of claim 1, wherein the pair of central electrodes includes a positive electrode and a negative electrode.

4. A spark plug comprising:

a metal body member formed of a metal material, the metal body member having two ends;

an insulating body member positioned inside the metal body member and formed of an insulating material;

a pair of central electrodes positioned inside the insulating body member and having different polarities; and a ground electrode formed across the pair of central electrodes at both ends of the metal body member;

wherein the ground electrode includes:

a first ground vertical portion extending downward from one lower end of the metal body member;

a second ground vertical portion extending downward from an other lower end of the metal body member; and a ground horizontal portion connecting the first ground vertical portion and the second ground vertical portion; and wherein a distance between the positive electrode and the ground horizontal portion and a distance between the negative electrode and the ground horizontal portion is shorter than a distance between the positive electrode and the negative electrode.

5. The spark plug of claim 4, wherein the pair of central electrodes are positioned at a predetermined distance from each other on a center of a lower part of the insulating body member.

6. The spark plug of claim 4, wherein the pair of central electrodes includes a positive electrode and a negative electrode.

7. A spark plug comprising:

a metal body member formed of a metal material;

an insulating body member positioned inside the metal body member and formed of an insulating material;

a pair of central electrodes positioned inside the insulating body member and having different polarities; and a ground electrode formed across the pair of central electrodes from the metal body member;

wherein the ground electrode includes:

a ground vertical portion extending downward from a lower end portion of the metal body member; and a ground horizontal portion extending from the ground vertical portion by a predetermined length; and wherein a distance between the positive electrode and the ground horizontal portion and the distance between the negative electrode and the ground horizontal portion are formed to be shorter than the distance between the positive electrode and the negative electrode.

8. The spark plug of claim 7, wherein the pair of central electrodes are positioned at a predetermined distance from each other on the lower center of the insulating body member.

9. The spark plug of claim 7, wherein the pair of central electrodes include a positive electrode and a negative electrode.

* * * * *